US010694921B2

(12) United States Patent
Carr et al.

(10) Patent No.: US 10,694,921 B2
(45) Date of Patent: Jun. 30, 2020

(54) WIRE DISHWARE AND CUTLERY RACK FOR DISHWASHER

(71) Applicants: BSH Home Appliances Corporation, Irvine, CA (US); BSH Hausgeräte GmbH, Munich (DE)

(72) Inventors: Casey Carr, New Bern, NC (US); James Michael Edwards, Newport, NC (US); Matthew Richards, New Bern, NC (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 278 days.

(21) Appl. No.: 15/423,617

(22) Filed: Feb. 3, 2017

(65) Prior Publication Data

US 2018/0220867 A1 Aug. 9, 2018

(51) Int. Cl.
*A47L 15/50* (2006.01)

(52) U.S. Cl.
CPC ..... *A47L 15/50* (2013.01); *A47L 15/502* (2013.01); *A47L 15/507* (2013.01); *A47L 15/501* (2013.01)

(58) Field of Classification Search
CPC ..... A47L 15/50; A47L 15/501; A47L 15/502; A47L 15/507
USPC ..... 312/228.1, 410; 134/135; 211/41.8, 41.9
See application file for complete search history.

(56) References Cited

U.S. PATENT DOCUMENTS 3,181,924 A * 5/1965 Guth ..... A47L 15/50 312/311
3,402,975 A * 9/1968 Smith ..... A47L 15/507 211/106
4,129,954 A * 12/1978 Hulteen ..... G09F 7/20 116/306
5,205,419 A * 4/1993 Purtilo ..... A47L 15/503 134/200
5,480,035 A * 1/1996 Smith ..... A47L 15/503 211/168
D383,880 S 9/1997 Good
6,848,585 B2 2/2005 VanLandingham
(Continued)

FOREIGN PATENT DOCUMENTS

EP 2554101 A1 2/2013
WO 2013045543 A1 4/2013

*Primary Examiner* — James O Hansen
(74) *Attorney, Agent, or Firm* — Michael E. Tschupp; Andre Pallapies; Brandon G. Braun

(57) ABSTRACT

A dishwasher, including: a dishwashing compartment having a loading opening; a door configured to close the loading opening; a bottom washware rack configured for movement out of and into the dishwashing compartment; a middle washware rack configured for movement out of and into the dishwashing compartment; and a top washware rack configured for movement out of and into the dishwashing compartment. The top rack is formed of wire thereby to hold washware including cutlery and to enhance drying performance. The spacing between an inner surface of a top wall of the dishwashing compartment and an upper surface of a deepest portion of the top rack is in a range of 79.0 mm to 83.0 mm. The top rack is formed with a notch section along at least one side in a bottom portion thereof, and include an angled portion to hold bowls at a slight tilt with respect to horizontal.

1 Claim, 6 Drawing Sheets

(56) References Cited

U.S. PATENT DOCUMENTS

| | | | | |
|---|---|---|---|---|
| 6,945,421 | B2 * | 9/2005 | Phifer | A47L 15/502 220/486 |
| 7,690,517 | B2 | 4/2010 | Purushothaman et al. | |
| 2003/0226580 | A1 * | 12/2003 | Welch | A47L 15/50 134/172 |
| 2006/0250058 | A1 * | 11/2006 | Stevens | A47L 15/502 312/311 |
| 2006/0254992 | A1 | 11/2006 | Lim | |
| 2006/0254994 | A1 | 11/2006 | Lim | |
| 2008/0110480 | A1 | 5/2008 | Choi et al. | |
| 2012/0298598 | A1 | 11/2012 | Ennen et al. | |
| 2014/0190528 | A1 * | 7/2014 | Wegener | A47L 15/502 134/92 |
| 2014/0197719 | A1 * | 7/2014 | Fey | A47L 15/50 312/228.1 |
| 2015/0196189 | A1 * | 7/2015 | Shaffer | A47L 15/502 312/228.1 |
| 2015/0245762 | A1 * | 9/2015 | Tuller | A47L 15/508 134/170 |
| 2015/0335225 | A1 * | 11/2015 | Seu | A47L 15/502 211/41.9 |
| 2016/0007824 | A1 * | 1/2016 | Maier | A47L 15/501 211/41.8 |
| 2016/0360946 | A1 * | 12/2016 | Shewmaker | A47L 15/507 |
| 2017/0027412 | A1 * | 2/2017 | Chan | A47L 15/503 |

* cited by examiner

WIRE DISHWARE AND CUTLERY RACK FOR DISHWASHER

FIELD OF THE INVENTION

The present disclosure relates generally to dishwasher appliances and to racks for holding dishware and cutlery for a dishwasher. More particularly, the present disclosure relates to a third or top washware rack that is made out of wire and that has greater spacing between an upper surface of a deepest portion of the top washware rack and an inner surface of a top wall of the dishwashing compartment.

BACKGROUND OF THE INVENTION

In general, most domestic dishwashers include two dishware racks to support items to be washed such as dishware, glassware, kitchen utensils, pots, pans, and the like. Typically, the two dishware racks include an upper dishware rack positioned near a top portion of the dishwasher, and a lower dishware rack arranged below the upper dishware rack. The upper dishware rack is used to support glassware, utensils, and other small items, while the lower dishware rack is used to support larger items, such as dinner plates, large bowls, cooking sheets, and baking pans. The dishware racks are normally formed from several discrete lengths of wire, welded together and then covered with a rubber or a plastic coating. Further, the dishware racks are formed with a plurality of vertically projecting tines to support and organize the items placed on the dishware rack.

Moreover, the use of a third, top washware rack is known per se in household dishwasher appliances. Such a third, top washware rack is positioned immediately above a second or middle washware rack. The second, middle washware rack is in turn positioned above a first or bottom washware rack that normally hold lager items, such as large dinner plates, etc., as noted above, inside the dishwashing compartment.

However, the known third, top washware racks are limited in their capacity, flexibility, and versatility.

SUMMARY OF THE INVENTION

More specifically, the known third, top washware racks have a large plastic insert piece that forms the basket of the rack and that is fitted over a wire frame. The wire frame is thus substantially hidden from view to the user by the plastic insert. The bulky plastic insert results in a relatively small clearance or spacing between an upper surface of a deepest portion of the top washware rack and an inner surface of a top wall of the dishwashing compartment, thereby limiting what can be placed on the third washware rack. Also, the bulky plastic insert that forms the basket of the third washware rack causes water to be retained and thus inhibits the drying performance of the dishwasher.

An apparatus consistent with the present disclosure is directed to a third, top washware rack that increases the dishwasher capacity, flexibility, and versatility, as well as enhancing the drying performance of the dishwasher.

An apparatus consistent with the present disclosure is directed to a third, top washware rack that is made out of wire and eliminates the bulky plastic insert. Thus, the third, top wire rack has a greater spacing between an upper surface of a deepest portion of the top washware rack and an inner surface of a top wall of the dishwashing compartment. Also, the third, top wire rack enhances the drying performance.

An apparatus consistent with the present disclosure is directed to a third, top washware rack that allows the dishwasher to accommodate specialty items such as stemmed wine glasses.

An apparatus consistent with the present disclosure is directed to a third, top washware rack that is configured to hold bowls at a slight tilt with respect to horizontal in order to drain off water from the bowls.

According to one aspect, the present disclosure provides a dishwasher, comprising: a dishwashing compartment having a loading opening; a door configured to close the loading opening; a bottom washware rack configured for movement out of and into the dishwashing compartment; a middle washware rack configured for movement out of and into the dishwashing compartment; and a top washware rack configured for movement out of and into the dishwashing compartment, wherein a spacing between an inner surface of a top wall of the dishwashing compartment and an upper surface of a deepest portion of the top washware rack is in a range of 79.0 mm to 83.0 mm.

According to another aspect, the present disclosure provides a dishwasher, wherein a further spacing between an upper edge of the top washware rack and the inner surface of the top wall of the dishwashing compartment is in a range of 9.0 to 10.5 mm.

According to another aspect, the present disclosure provides a dishwasher, wherein the further spacing is 9.85 mm±0.5 mm.

According to another aspect, the present disclosure provides a dishwasher, comprising: a dishwashing compartment having a loading opening; a door configured to close the loading opening; a bottom washware rack configured for movement out of and into the dishwashing compartment; a middle washware rack configured for movement out of and into the dishwashing compartment; and a top washware rack configured for movement out of and into the dishwashing compartment, wherein the top washware rack is formed of wire thereby to hold washware including cutlery and washware which is larger than cutlery and to enhance drying performance.

According to another aspect, the present disclosure provides a dishwasher, wherein the wire is formed entirely of stainless steel.

According to another aspect, the present disclosure provides a dishwasher, wherein the wire is formed of carbon steel having a coating of Nylon powder.

According to another aspect, the present disclosure provides a dishwasher, comprising: a dishwashing compartment having a loading opening; a door configured to close the loading opening; a bottom washware rack configured for movement out of and into the dishwashing compartment; a middle washware rack configured for movement out of and into the dishwashing compartment; and a top washware rack configured for movement out of and into the dishwashing compartment, wherein the middle washware rack is configured on at least one side to hold one or more stemmed wine glasses; and wherein the top washware rack is formed with a notch section along at least one side in a bottom portion thereof in order to accommodate base portions of the one or more stemmed wine glasses.

According to another aspect, the present disclosure provides a dishwasher, wherein the stemmed wine glasses having a height of approximately 9 inches.

According to another aspect, the present disclosure provides a dishwasher, wherein the top washware rack, at a location directly above the notch section, is configured to accommodate at least one of cutlery or utensils.

According to another aspect, the present disclosure provides a dishwasher, comprising: a dishwashing compartment having a loading opening; a door configured to close the loading opening; a bottom washware rack configured for movement out of and into the dishwashing compartment; a middle washware rack configured for movement out of and into the dishwashing compartment; and a top washware rack configured for movement out of and into the dishwashing compartment, wherein the top washware rack comprises a bottom portion having at least one angled portion that is configured to hold bowls at a slight tilt with respect to horizontal in order to drain off water from the bowls.

According to another aspect, the present disclosure provides a dishwasher, wherein the at least one angled portion is tilted at an angle in a range of 3 to 5 degrees with respect to horizontal.

According to another aspect, the present disclosure provides a dishwasher, wherein the at least one angled portion is tilted at an angle of approximately 4 degrees with respect to horizontal.

According to another aspect, the present disclosure provides a dishwasher, wherein the at least one angled portion includes stopper ribs to keep bowls from sliding in a front-back direction on the top washware rack.

According to another aspect, the present disclosure provides a dishwasher, wherein the at least one angled portion is configured to hold bowls that are of a standard 6 inch diameter in size.

According to another aspect, the present disclosure provides a dishwasher, wherein the at least one angled portion comprises two angled portions disposed side-by-side.

According to another aspect, the present disclosure provides a dishwasher, wherein a front wall of the top washware rack includes a form for mounting thereon a handle.

According to another aspect, the present disclosure provides a dishwasher comprising a first, bottom washware rack, a second, middle washware rack, and a third, top washware rack, wherein the third, top washware rack is formed from wire; wherein the third, top washware rack comprises a bottom portion having at least one angled portion that is configured to hold bowls at a slight tilt of approximately 4 degrees with respect to horizontal in order to drain off water from the bowls; and wherein the third, top washware rack is formed with a notch section along at least one side in a bottom portion thereof in order to accommodate base portions of one or more stemmed wine glasses supported on the second, middle washware rack.

BRIEF DESCRIPTION OF THE DRAWING FIGURES

The accompanying drawing figures incorporated in and forming a part of this specification illustrate several aspects of the invention, and together with the description serve to explain the principles of the invention.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as right, left, right side, left side used herein are for orientation purposes with respect to the drawings when describing the exemplary embodiments and should not limit the present invention. Also, terms such as substantially, approximately, and about are intended to allow for variances to account for manufacturing tolerances, measurement tolerances, or variations from ideal values that would be accepted by those skilled in the art.

Figure 1:
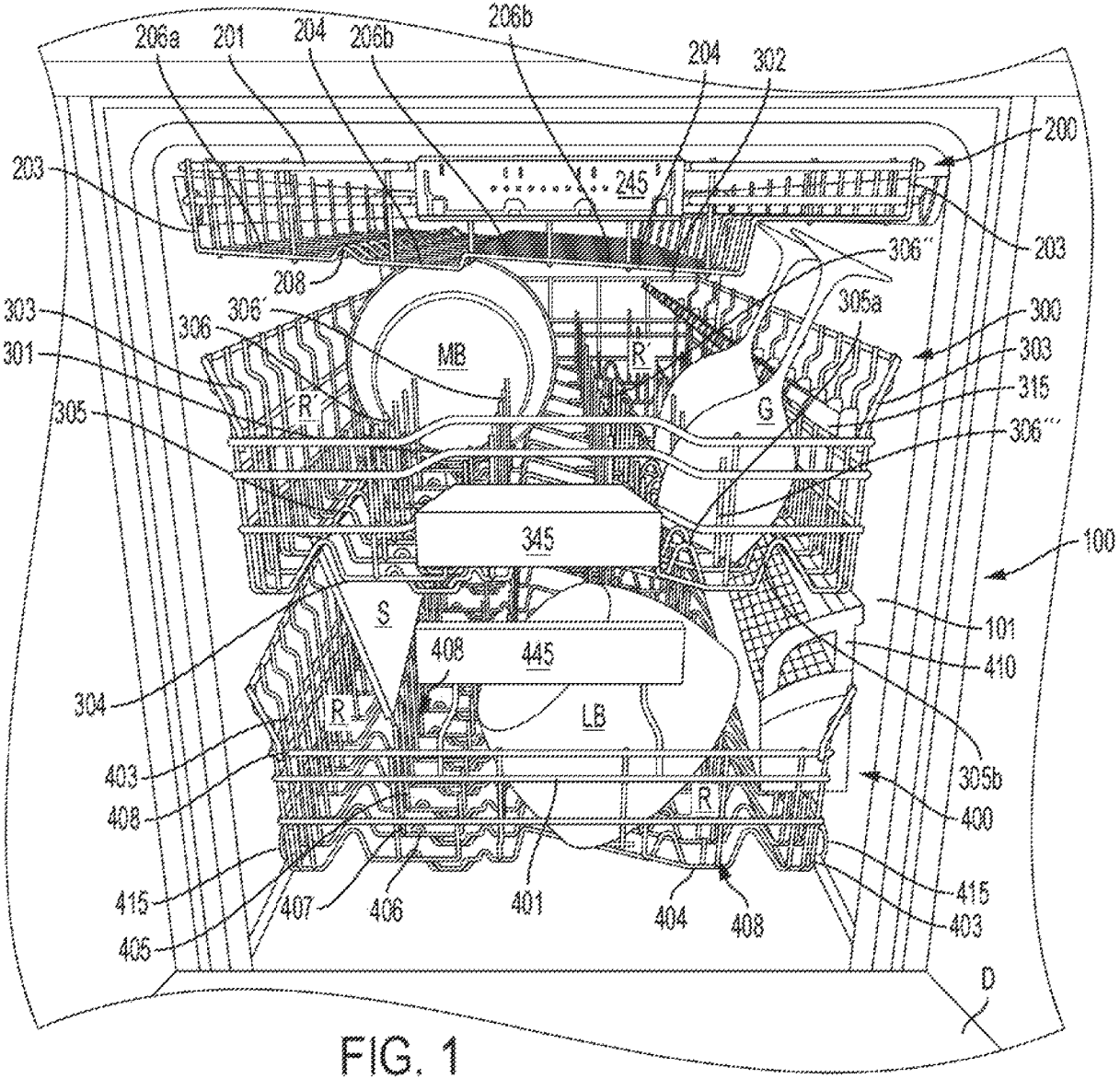
FIG. 1 is a front perspective view of a dishwasher appliance according to an exemplary embodiment consistent with present disclosure, with the door open so as to reveal the dishwashing compartment including a third, top washware rack that is positioned immediately above the second or middle washware rack, which is in turn positioned above the first or bottom washware rack.

FIG. 1 is a front perspective view of a dishwasher appliance 100 according to an exemplary embodiment consistent with present disclosure, with the door D (only a portion being shown) open so as to reveal the dishwashing compartment 101 having a loading opening and including a third, top washware rack 200 that is positioned immediately above a second or middle washware rack 300. The middle washware rack 300 is in turn positioned above a first or bottom washware rack 400.

Although not shown, as is known in the art, the dishwasher appliance 100 includes a tub, a pump and filter assembly, a heating element, one or more wash arms, and a drain hose. A detailed description of the suitable structure and operation of the dishwasher appliance 100 does not form part of the present disclosure, but can be found, for example, in U.S. Pat. Nos. 9,445,703 and 9,510,729 which are incorporated herein by reference.

More specifically, the first or bottom washware rack 400 is configured as a basket for holding larger plates, large bowls LB, pans, cookware such as a cooking sheet S, etc. The bottom washware rack 400 includes front 401, rear (not shown), and opposing side walls 403 interconnected with a bottom portion 404 and formed by a plurality of wire shaped elements. The bottom washware rack 400 includes a plurality of tine members 405. The tine members 405 include a base member 406 from which extend a plurality of tines 407. The tines 407 form tine rows 408 to establish dish/utensil support regions R in the bottom washware rack 400. A utensil insert 410 may be included for holding utensils such as knives, forks, spoons, and other specialty items. At the bottom portion of the bottom washware rack 400 at the left and right sides thereof, rollers 415 configured to run on corresponding flanges or tracks on the inside wall of the dishwashing compartment 101 and also on an inside surface of the door, as is conventional in the art. The bottom washware rack 400 can include a handle 445.

The second or middle washware rack 300 is positioned immediately above the bottom washware rack 400. The middle washware rack 300 is configured as a basket to hold medium sized dishes, bowls such as medium sized bowls MB, and glasses on one side, as well as stemmed wine glasses G on an opposite side as will be discussed in more detail below. The middle washware rack 300 includes front 301, rear 302, and opposing side walls 303 interconnected with a bottom portion 304 and formed by a plurality of wire shaped elements. The bottom portion 304 includes a plurality of forms 305 for holding items in place on the middle washware rack 300. A plurality of sets of retractable, rotatable or flip tines (306, 306', 306", 306'") (see also FIG. 4) may be included to customize the support regions R'. On the right hand side of the bottom portion 304 of the middle washware rack 300, the plurality of forms 305 include rows of forms 305*a* and 305*b* for supporting stemmed wine glasses G. In this regard, a plurality of stem supports or holders 315 extend from the right hand sidewall of the middle washware rack 300. Each of the stem holders 315 can be mounted to an individual base member or a common base member. The individual base members or common base member can be rotatably mounted to the sidewall of the middle washware rack 300 so that the stem holders 315 can be pivoted upwardly to a substantially vertical, stowed position when not in use. The interaction of the base of each of the stemmed wine glasses will be discussed in more detail below with respect to the third, top washware rack 200. The middle washware rack 300 can include a handle 345. The details of the technology that may be used for the rotatable or flip tines 306-306'" and the stem holders 315 can be found, for example, in Bosch Dishwasher Models: SHX7PT55UC and SHX8PT55UC.

As noted above, the bottom washware rack 400 and the middle washware racks 300 are formed of wire shaped elements that are configured to have a basket shape. The wire shaped elements of the bottom and middle washware racks 400 and 300, respectively, may be formed of solid plastic, metal wire coated with plastic or rubber, or composite materials.

As shown in FIGS. 1-6, the third, top washware rack 200 is configured to hold cutlery and washware which is larger than cutlery such as, but not limited to, small dishes, bowls, cups, as well as cooking utensils. The third, top washware rack 200 may be made entirely out of metal wire, such as stainless steel wire. Alternatively, and preferably, the third, top washware rack 200 is made from carbon steel that is dipped in Nylon powder, so that the wire is coated. By forming the third, top washware rack 200 from wire and eliminating the bulky plastic insert, this allows for enhanced drying performance by permitting quicker drying of items placed on the wire third rack 200. The third, top washware rack 200 is configured as a basket and includes front 201, rear 202, and opposing side walls 203 interconnected with a bottom portion 204 and formed by a plurality of wire shaped elements formed either entirely out of metal, or metal dipped in, for example, a Nylon powder.

Figure 4:
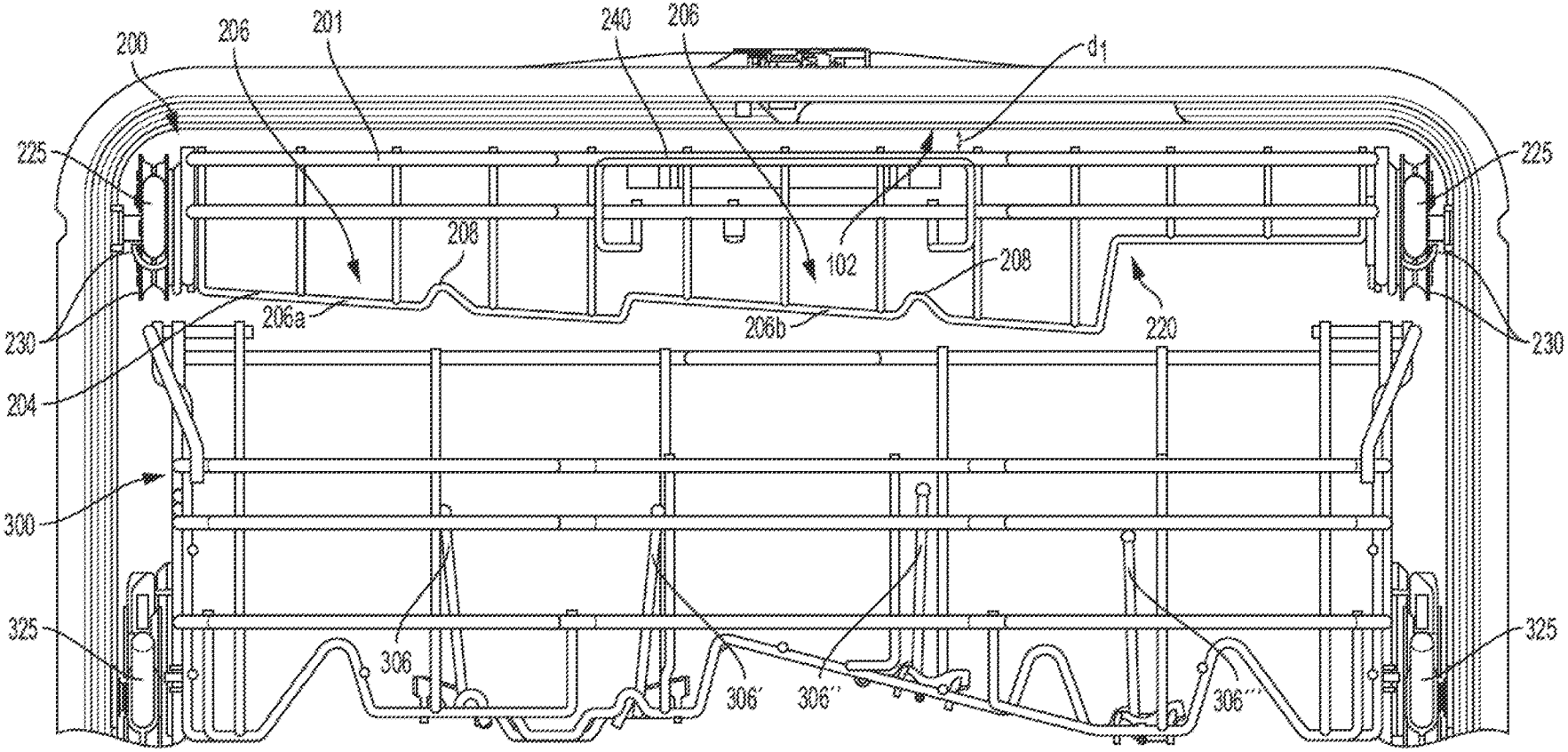
FIG. 4 is an enlarged front view of an upper portion of the dishwasher appliance showing the third, top washware rack and the middle or second rack according to an exemplary embodiment consistent with present disclosure.
Figure 5:
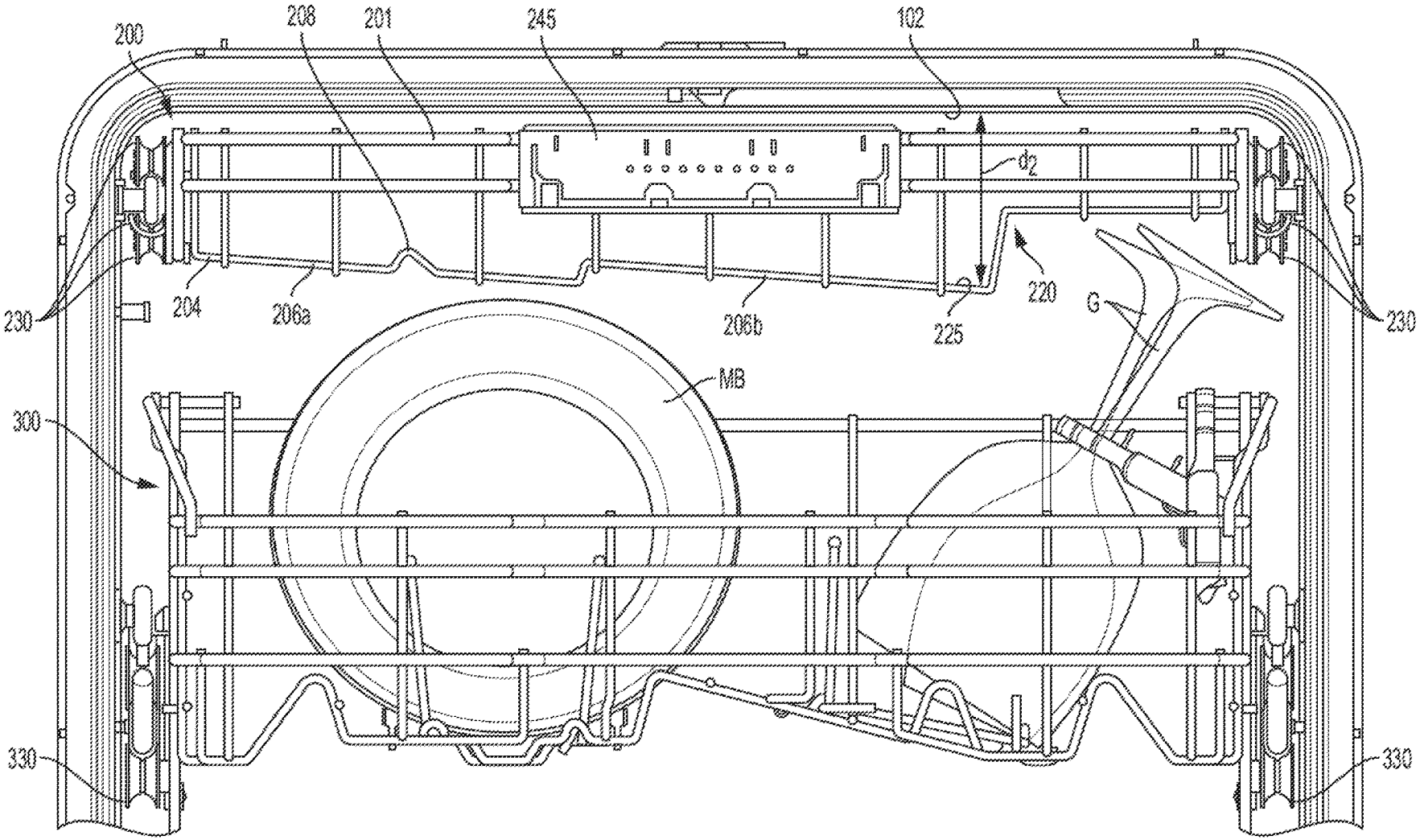
FIG. 5 is a view similar to FIG. 4 but also showing the presence of a bowl and stemmed wine glasses in the second or middle washware rack according to an exemplary embodiment consistent with present disclosure. Also, only a single row of stopper ribs are included.

As best shown in FIGS. 4 and 5, the middle washware rack 300 and the third, top washware rack 200 can be displaced in a forward direction and a rearward direction in each instance by way of rollers 325 and 225, respectively, or the like for easier loading and unloading. The rollers 325, 225 can be mounted on the sidewalls of the dishwasher compartment 101 and configured to cooperate with corresponding rails/rollers 330/230 disposed on the sidewalls of the middle washware rack 300 and the third, top washware rack 200. The details of technology that may be used for the rack roller systems for the middle washware rack 300 and third, top washware rack 200 can also be found, for example, in Bosch Dishwasher Models: SHX7PT55UC and SHX8PT55UC.

The bottom portion 204 includes one or more angled portions 206 that is/are configured to hold bowls at a slight tilt with respect to horizontal in order to drain off water from the bowls. Each angled portion 206 is tilted at an angle in a range of 3 to 5 degrees with respect to horizontal, and preferably is tilted at an angle of approximately 4 degrees with respect to horizontal. FIGS. 1-6 show two angled portions 206*a* and 206*b* disposed side-by-side.

Figure 2:
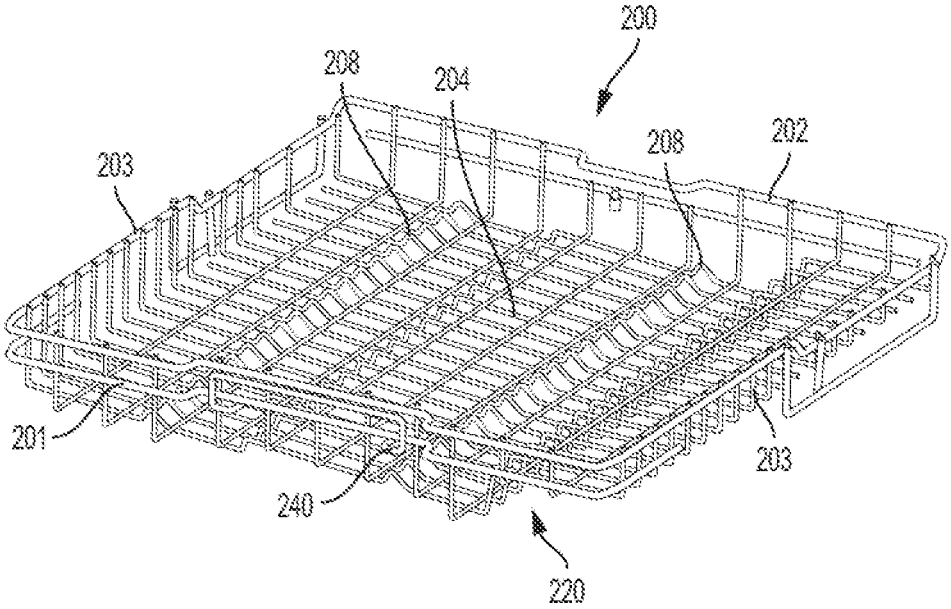
FIG. 2 is a top, perspective view of the third, top washware rack but without the roller/rail assembly according to an exemplary embodiment consistent with present disclosure.
Figure 3:
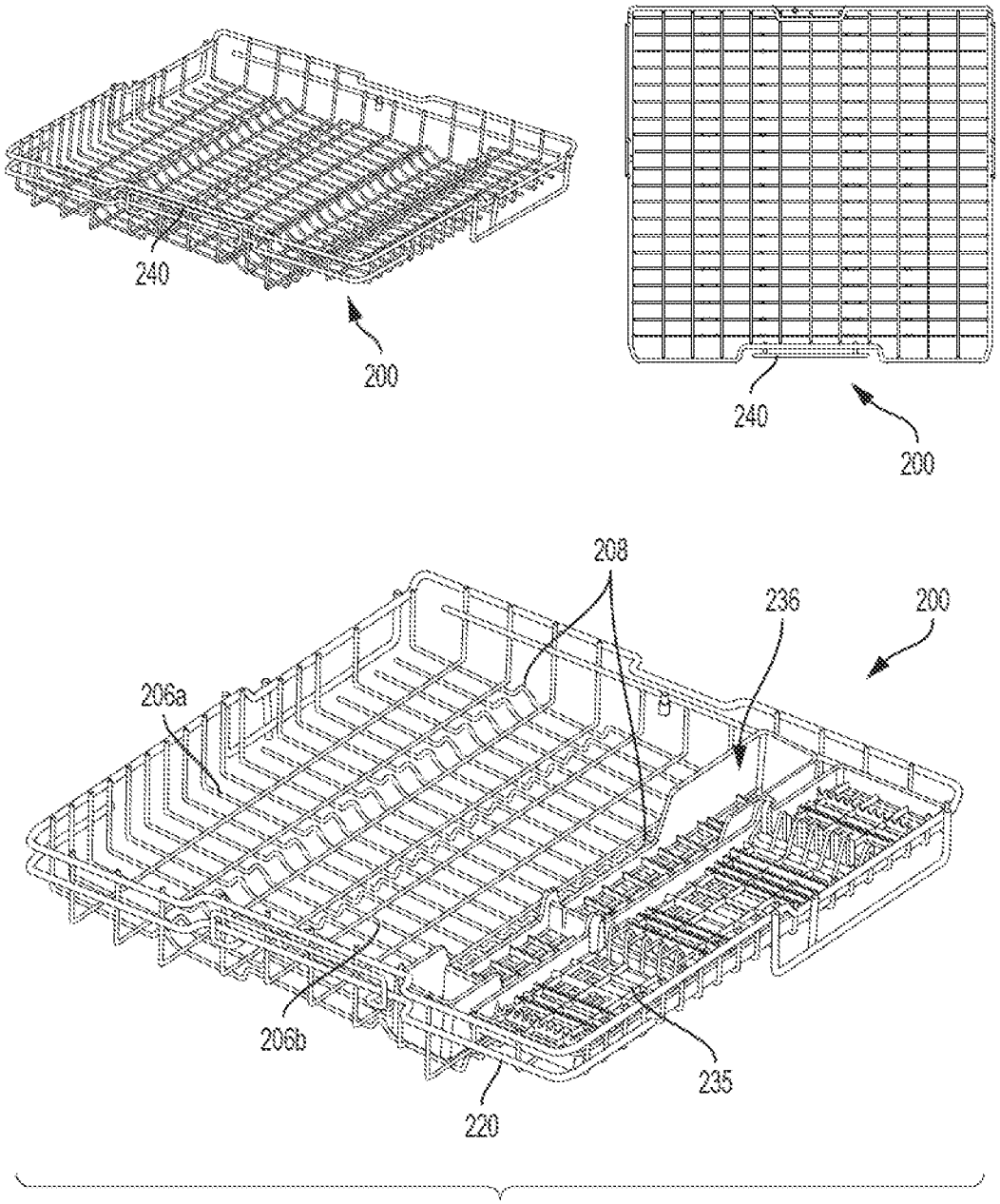
FIG. 3 is a series of views including a view similar to FIG. 2 but including accessory inserts to hold specialized items according to an exemplary embodiment consistent with present disclosure.
Figure 6:
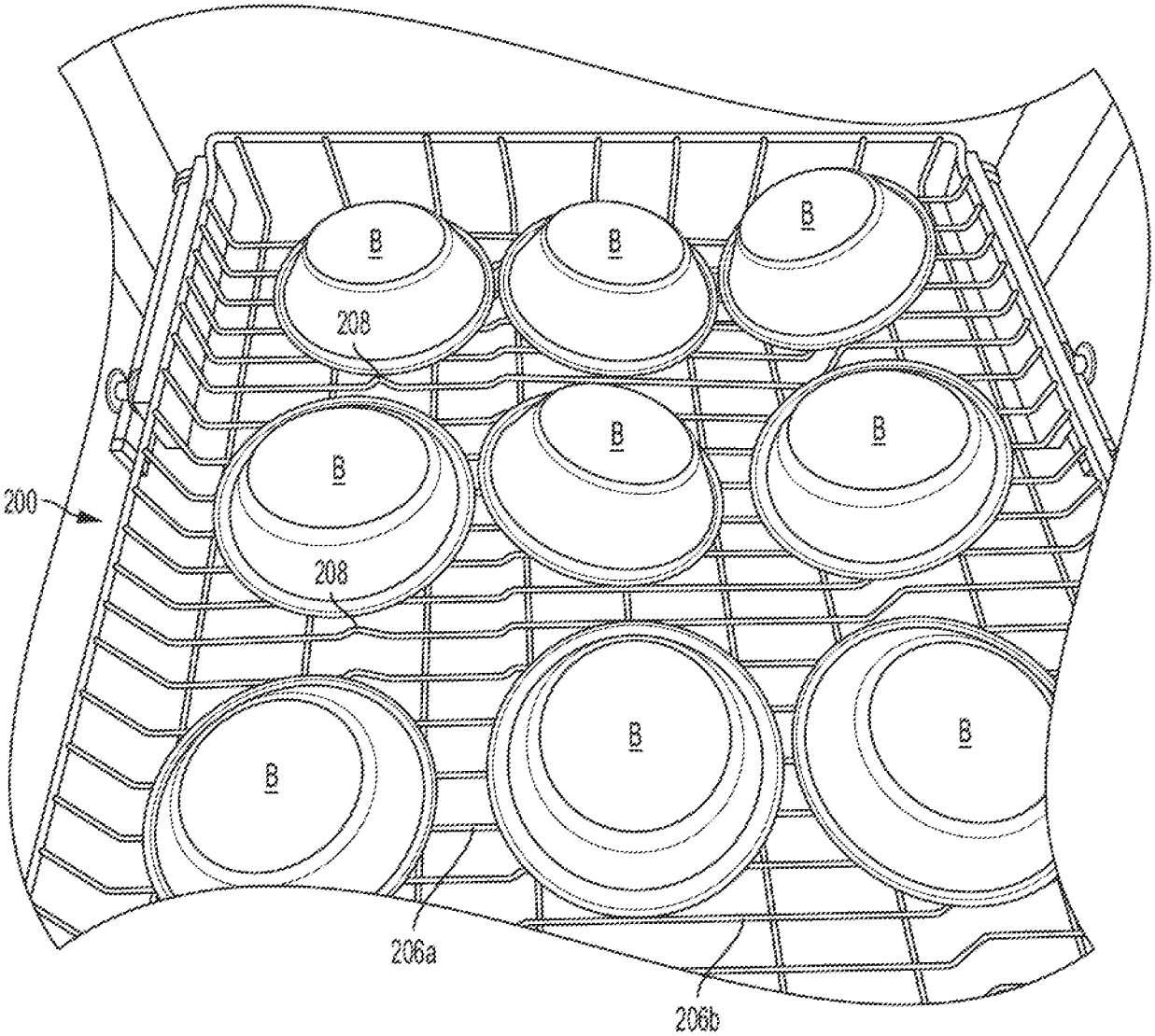
FIG. 6 is a top perspective view of the third, top washware rack showing the presence of bowls according to an exemplary embodiment consistent with present disclosure.

As best shown in FIGS. 2-4, each angled portion 206*a* and 206*b* includes stopper ribs or forms 208 to keep bowls from sliding in a front-back direction on the third, top washware rack. Further, each angled portion is configured to hold bowls that are of a standard 6 inch diameter in size. As shown in FIGS. 1, 5, and 6, the stopper ribs or forms 208 may be included on just one side, for example, in angled portion 206*a* but not in angled portion 206*b*. Alternatively, the stopper ribs or forms 208 may be included in the angled portion 206*b* but not in angled portion 206*a*.

As best shown in FIG. 4, the spacing designated as the distance ($d_1$) between an upper edge of the third, top washware rack 200 and an inner surface of a top wall 102 of the dishwashing compartment 101 is in a range of 9.0 to 10.5 mm, and preferably the spacing is 9.85 mm±0.5 mm.

According to another aspect, a further spacing (designated as distance $d_2$ in FIG. 5) between the inner surface of the top wall 102 of the dishwashing compartment 101 and an upper surface of a deepest portion 225 of the third, top washware rack 200 is in a range of 79.0 mm to 83.0 mm. Preferably, but not necessarily, the distance $d_2$ is 81.08 mm. It is noted that if the second, middle washware rack 300 is a multi-position rack (for example, 3-position), then this would serve as a limit on the distance $d_2$ of the third, top washware rack 200 when the second, middle washware rack 300 is in its highest position, with each of the positions being spaced apart by about 25 mm. On the other hand, if the multi-position rack is a 2-position rack, then the distance $d_2$ of the third, top washware rack 200 may be greater, for example, in a range of 104 mm to 108 mm. The details of the technology that may be used for a multi-position rack per se can be found, for example, in Bosch Dishwasher Models: SHX7PT55UC and SHX8PT55UC noted above. This greater spacing between an upper surface of a deepest portion 225 of the third, top washware rack and an inner surface of a top wall 102 of the dishwashing compartment 101 greatly enhances the versatility of the third, top washware rack 200 over conventional dishwasher configurations which are limited to holding only cutlery and other very small items due to limited spacing.

As best shown in FIGS. 4 and 5, the third, top washware rack 200 is formed with a notch section 220 along at least one side (for example, shown on the right side) in the bottom portion 204 thereof in order to accommodate base portions of the one or more stemmed wine glasses G (see FIGS. 1 and 5) that are supported below on the middle washware rack

300. The notch section 220 is configured to accommodate standard stemmed wine glasses having a height of approximately 9 inches.

According to another aspect, the third, top washware rack 200, at a location directly above the notch section 220, is configured to accommodate at least one of cutlery or utensils. A cutlery/utensil accessory insert 235 is shown in FIG. 3 disposed above the notch section 220. An additional cutlery accessory insert 236 can be included in the space next to the position of the notch section 220 above which the cutlery/utensil accessory insert 235 is disposed, as shown in FIG. 3.

As best shown in FIGS. 3, 4, and 5, the third, top washware rack 200 can include a form 240 on the front wall 201 for mounting thereon a handle 245.

FIG. 6 is a top perspective view showing the third, top washware rack 200 with the inserts 235 and 236 removed and with standard sized 6 inch diameter bowls B placed thereon. The stopper ribs or forms 208 are shown on the angled portion 206*a*, but not on the angled portion 206*b*.

The present invention has substantial opportunity for variation without departing from the spirit or scope of the present invention. For example, additional or different inserts for various utensils and cutlery may be included in any of the top, middle, or bottom washware racks.

Those skilled in the art will recognize improvements and modifications to the exemplary embodiments of the present invention. All such improvements and modifications are considered within the scope of the concepts disclosed herein and the claims that follow.

What is claimed is:

1. A dishwasher, comprising:

a dishwashing compartment having a loading opening;

a door configured to close the loading opening;

a bottom washware rack configured for movement out of and into the dishwashing compartment;

a middle washware rack configured for movement out of and into the dishwashing compartment; and a top washware rack configured for movement out of and into the dishwashing compartment;

wherein the middle washware rack is configured on at least one side to hold one or more stemmed wine glasses;

wherein the top washware rack is configured as a basket formed by a plurality of wire shaped elements, the plurality of wire shaped elements including a front wall, a rear wall, opposing side walls, and a bottom portion fixed together in a non-adjustable manner as a unitary member, the plurality of wire shaped elements being formed of metal having a coating of Nylon powder, thereby to hold washware including cutlery and washware which is larger than cutlery and to enhance drying performance;

wherein the plurality of wire shaped elements that form the basket are formed with a vertically extending notch section along at least one side edge portion in the bottom portion of the basket, the vertically extending notch section being shaped to accommodate base portions of the one or more stemmed wine glasses supported on the middle washware rack;

wherein the vertically extending notch section forms a stepped portion in the bottom portion of the basket such that a horizontal top surface of the stepped portion in the bottom portion of the basket is located closer to an inner surface of a top wall of the dishwashing compartment as compared to a remainder of the bottom portion of the basket; and wherein the plurality of wire shaped elements are formed of carbon steel having the coating of Nylon powder.

* * * * *